US006047583A

United States Patent [19]

Schroth

[11] Patent Number: 6,047,583

[45] Date of Patent: Apr. 11, 2000

[54] SEAL BEAD FOR SUPERPLASTIC FORMING OF ALUMINUM SHEET

[75] Inventor: James Gregory Schroth, Troy, Mich.

[73] Assignee: General Motors Corporation, Detroit, Mich.

[21] Appl. No.: 09/307,837

[22] Filed: May 10, 1999

[51] Int. Cl.[7] ..... B21D 26/02; B21D 22/22

[52] U.S. Cl. ..... 72/60; 72/57; 72/350

[58] Field of Search ..... 72/350, 60, 57

[56] References Cited

U.S. PATENT DOCUMENTS

| | | | |
|---|---|---|---|
| 4,087,037 | 5/1978 | Schier et al. | 228/106 |
| 4,197,978 | 4/1980 | Kasper | 228/173 A |
| 4,331,284 | 5/1982 | Schulz et al. | 72/60 |
| 4,603,808 | 8/1986 | Stacher | 228/265 |
| 4,691,857 | 9/1987 | Friedman | 228/265 |
| 5,035,133 | 7/1991 | White et al. | 72/350 |
| 5,157,969 | 10/1992 | Roper | 72/60 |
| 5,603,449 | 2/1997 | Mansbridge et al. | 228/157 |

FOREIGN PATENT DOCUMENTS

| | | | |
|---|---|---|---|
| 1088844 | 4/1984 | U.S.S.R. | 72/350 |
| 1456265 | 2/1989 | U.S.S.R. | 72/350 |
| 1547920 | 3/1990 | U.S.S.R. | 72/350 |

OTHER PUBLICATIONS

Hamilton et al, "Superplastic Sheet Forming," *Metals Handbook, Ninth Edition*, vol. 14, "Forming and Forging," pp. 852–867.

*Primary Examiner*—David Jones
*Attorney, Agent, or Firm*—George A. Grove

[57] ABSTRACT

A cusp-shaped binder surface seal bead for a superplastic forming die or tool engages a sheet workpiece, especially an aluminum sheet, in a gas tight seal but displaces so little workpiece material that the formed sheet does not bond to the tool and is easily removed at the completion of the forming operation. The cusp shape may be truncated and the seal shape may incorporate adjacent valleys recessed in the otherwise flat binder surface.

12 Claims, 3 Drawing Sheets

SEAL BEAD FOR SUPERPLASTIC FORMING OF ALUMINUM SHEET

TECHNICAL FIELD

This invention relates to the superplastic forming of aluminum alloy sheet. More specifically, this invention relates to a seal design for the binder surface of a stretch forming tool in such superplastic forming operation.

BACKGROUND OF THE INVENTION

There are metal alloys, for example, some aluminum, magnesium and titanium alloys, that display exceptional ductility when deformed under controlled conditions. These aluminum alloys are susceptible to extensive deformation under relatively low shaping forces. Such alloys are characterized as being superplastic. The tensile ductility of superplastic metal alloys typically ranges from 200% to 1000% elongation.

Superplastic alloy sheets are formed by a variety of processes into articles of manufacture that are frequently of complex shape. These superplastic forming (SPF) processes are usually relatively slow, controlled deformation processes that yield complicated products. But an advantage of SPF processes is that they often permit the manufacture of large single parts that cannot be made by other processes such as conventional sheet metal stamping. Sometimes a single SPF part can replace an assembly of several parts made from non-SPF materials and processes.

There is a good background description of practical superplastic metal alloys and SPF processes by C. H. Hamilton and A. K. Ghosh entitled "Superplastic Sheet Forming" in *Metals Handbook, Ninth Edition*, Vol. 14, pages 852–868. In this text several suitably fine grained, superplastic aluminum and titanium alloys are described. Also described are a number of SPF processes and practices for forming superplastic materials. One practice that is adaptable to forming relatively large sheets of relatively low cost superplastic aluminum alloys into automobile body panels or the like is stretch forming.

As described, stretch forming comprises gripping or clamping the flat sheet blank at its edges, heating the sheet to its SPF temperature and subjecting one side to the pressure of a suitable gas such as air or argon. The central unclasped portion of the heated sheet is stretched and plastically deformed into conformity with a shaping surface such as a die cavity surface. The term "blow forming" applies where the working gas is at a superatmospheric pressure (for example, up to 690 to 3400 kPa or 100 psi to 500 psi). Vacuum forming describes the stretch forming practice where air is evacuated from one side of the sheet and the applied pressure on the other side is limited to atmospheric pressure, about 15 psi. As stated, the sheet and tools are heated to a suitable SPF condition for the alloy. For SPF aluminum alloys, this temperature is typically in the range of 400° C. to 550° C. The rate of pressurization is controlled so the strain rates induced in the sheet being deformed are consistent with the required elongation for part forming. Suitable strain rates are usually 0.0001 to 0.01 $s^{-1}$.

In stretch forming, a blank is tightly clamped at its edges between complementary surfaces of opposing die members. A schematic example is shown in FIG. 9, p. 857 of the Hamilton et al article, supra. At least one of the die members has a cavity with a forming surface opposite one face of the sheet. The other die opposite the other face of the sheet forms a pressure chamber with the sheet as one wall to contain the working gas for the forming step. The dies and the sheet are maintained at an appropriate forming temperature. Electric resistance heating elements are located in press platens or sometimes embedded in ceramic or metal pressure plates located between the die members and the platens. A suitable pressurized gas such as air is gradually introduced into the die chamber on one side of the sheet, and the hot, relatively ductile sheet is stretched at a suitable strain rate until it is permanently reshaped against the forming surface of the opposite die. During the deformation of the sheet, gas is vented from the forming die chamber.

In the SPF stretch forming process, the periphery of the sheet is held in a fixed position between "binder surfaces" of the forming dies or tools. The binder surfaces of the dies grip the sheet in a gas tight seal and the sheet does not flow over the binder surface as is typical in a conventional deep drawing operation. It is common to use a raised land seal bead to grip the periphery of the sheet. FIG. 10, page 857 of the Hamilton et al article, supra, shows a trapezoidal bead machined into the otherwise flat binder surface of one of the SPF forming tools. The binder surface of the opposing tool may be machined flat as shown in FIG. 10(*a*), or it may be machined to have a complementary trapezoidal recess as shown in FIG. 10(*b*). More commonly, male rectangular cross-section beads are employed on one tool surface while the opposing binder surface is flat. A typical bead has a raised rectangular or trapezoidal cross-section approximately 10–15 millimeters wide and 0.5–1 mm tall.

A problem encountered in superplastic forming is the sticking of the formed sheet to the tool in the vicinity of the seal bead during part extraction. Because the sheet components are very deformable at the forming temperature, sticking can distort the panel during panel extraction. The problem is particularly acute with aluminum sheet and severely slows the effective removal of an SPF-formed part from the binder portions of the tools. Sticking between the aluminum sheet and the die faces occurs primarily on the raised bead face but also on the opposing flat face. The sticking is due to reaction of the die surfaces with freshly exposed, unoxidized aluminum.

This unoxidized, reactive aluminum is exposed at the sheet surface as a result of plastic deformation of the aluminum sheet during the clamping process prior to sheet forming. As the die is closed, aluminum is extruded (locally) away from the volume clamped between the bead and the opposing tool side. As a result, the protective aluminum oxide film on the aluminum sheet surface is ruptured, and highly reactive aluminum is brought into intimate contact with the tool surface. The SPF forming tools are often made of, e.g., 1020 steel, ductile cast iron or aluminum. For most such tool materials, local reaction or microwelding occurs which can locally bond the aluminum sheet to the tool and cause sticking and tearing during subsequent part removal.

This part sticking problem may be tolerable when low volume production parts can be carefully pried from the tool, but the problem cannot be tolerated when high production rates are required. To adapt SPF to the production of automotive panels, e.g., practices must be developed that facilitate fast removal of an SPF-formed part from the forming tools.

SUMMARY OF THE INVENTION

This invention provides new seal bead shapes for SPF forming tools that engage a metal sheet (especially aluminum) in a gas tight seal suitable for stretch forming. But the shape of the seal bead limits deformation of the sheet so that the sheet does not stick to the bead or tool during or after the forming operation.

A bead with a cusp cross-sectional shape is machined into the binder surface of one of the dies or forming tools that engage the periphery of the SPF sheet material. The term "cusp" usually refers to the shape formed by the intersection of two arcs. In the practice of this invention, a linear cusp-shaped seal bead is suitably formed by machining the binder surface of a metal SPF tool using two offset spherical cutters moved in suitably-spaced parallel paths. The offset cutters form a bead with a cusp cross section. The bead is cut in a suitable path, typically a linear path, around the periphery of the tool as necessary to enclose and sealingly engage the perimeter of the workpiece. In general, it is only necessary to form the cusp-shaped cross section bead in one of the cooperating tools.

It has been found that a cusp-shaped bead displaces a lower volume of the SPF sheet than a rectangular, trapezoidal or even triangular cross-section bead. Therefore, less reactive aluminum is brought into contact with the tool and the sticking reaction is reduced. Thus, the cusp shape penetrates the sheet to provide a gas tight seal but with minimal contact area so that the formed product is readily released from the beaded binder surface.

A valley may be provided on one or both sides of the cusp in the otherwise flat binder surface by suitable penetration with the cusp forming cutting tools. Preferably, two valleys are formed and, as will be illustrated further in this specification, they provide parallel volumes on the sides of the bead for metal from the aluminum sheet to flow when deformed by penetration of the cusp. Furthermore, the cusp may be suitably truncated, i.e., the tip of the cusp may be machined flat to provide the benefits of this invention. The flat on the truncated cusp-shaped bead facilitates adjacent tool spotting during manufacture.

These and other objects and advantages of the invention will become further understood from a detailed description of preferred embodiments which follows. Reference will be had to the drawing figures which are summarized in the next section.

DESCRIPTION OF THE PREFERRED EMBODIMENT

Figure 1:
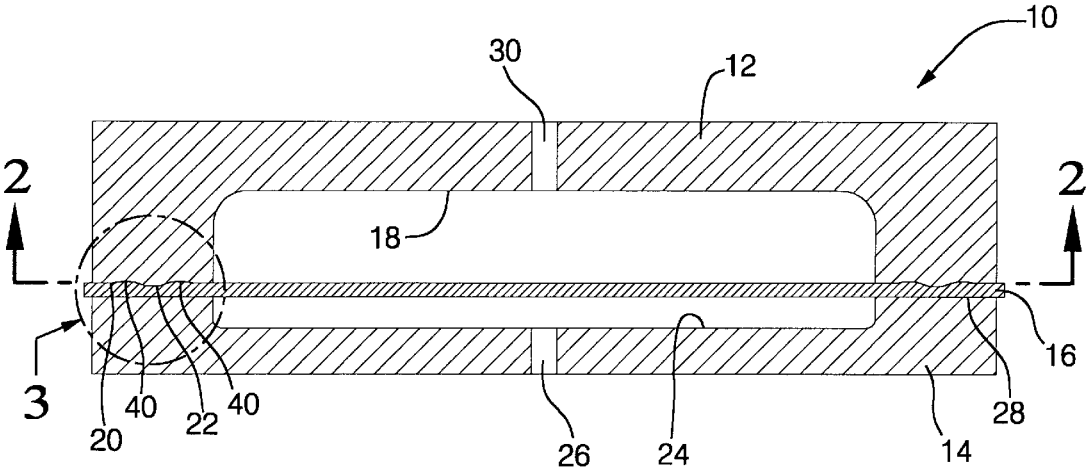
FIG. 1 is a cross-sectional view of a pair of complementary SPF forming tools engaging an aluminum alloy sheet. The upper tool provides the forming surface for the sheet and has a binder surface with the cusp-shaped bead of this invention.

The practice of this invention will be illustrated in the context of the stretch forming of a shallow pan from a superplastic aluminum alloy sheet. The shallow pan configuration is analogous to the stretch forming of curved automotive body panels and the like. An SPF stretch forming process typically employs two complementary tools that sealingly engage the periphery of the sheet workpiece to be formed as illustrated in FIG. 1.

Complementary tool set 10 includes a stretch forming die or tool 12 and cooperating tool 14. The material to be formed is a sheet 16 of aluminum alloy that is of a composition and processing history such that it is susceptible to superplastic forming. An example of such a material is Aluminum Alloy 5083. This alloy has a nominal composition, by weight, of 4 to 4.9 percent magnesium, 0.4 to 1 percent manganese, 0.05 to 0.25 percent chromium, up to about 0.1 percent copper and the balance aluminum. The cold rolled sheet is processed for superplastic forming so that it has a fine, stable grain structure of about 10 micrometers grain size.

Figure 2:
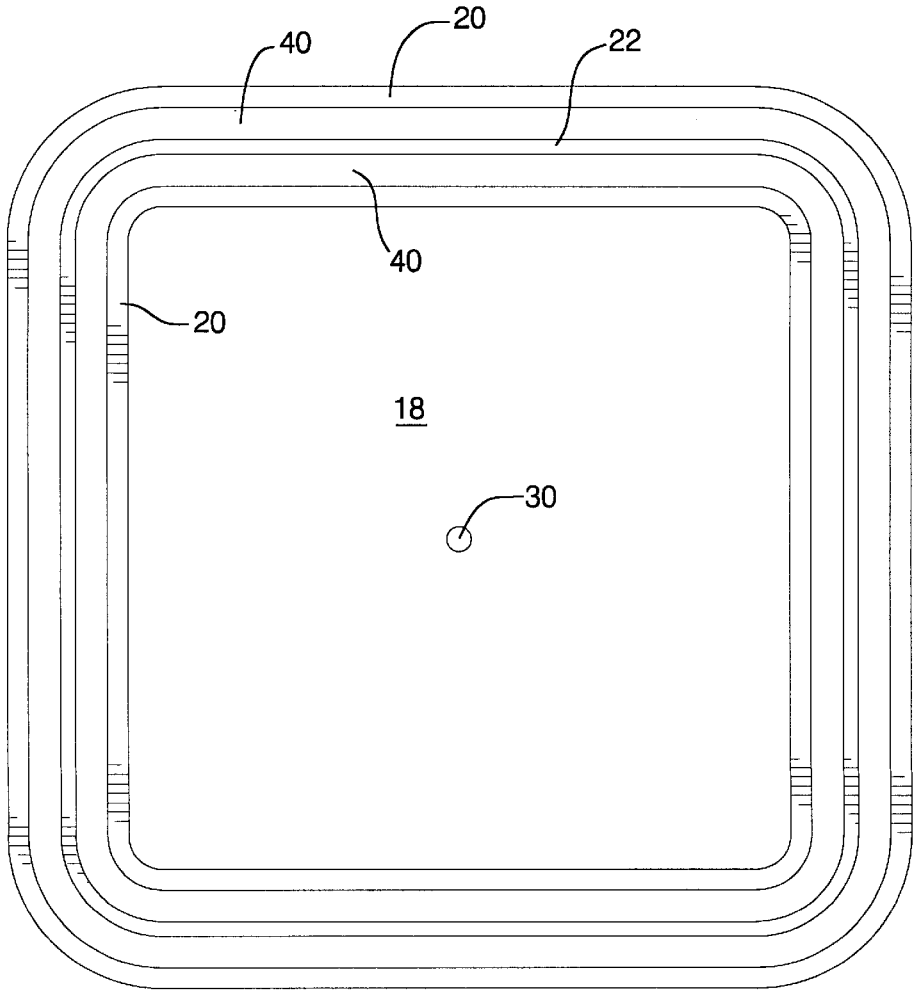
FIG. 2 is a plan view of the upper tool as illustrated in FIG. 1 in direction 2—2 as shown in FIG. 1.

Sheet 16 is suitably about 1.5 mm thick and in the form of a square of sufficient size to form the desired pan. The forming tool 12 as seen in the FIGS. 1 and 2 has a part-forming cavity surface 18 that has been cast and machined into the tool body. Forming surface 18 defines the bottom, sides and lip of the pan structure. The tool body is suitably formed of 1020 steel, ductile cast iron or cast aluminum. At the perimeter of the square-forming surface 18 is the binder surface 20 portion of tool 12. Binder surface 20 is flat except for the seal bead 22 and shallow valleys 40, one on each side of bead 22. In other words, the major portion of the binder surface 20 is flat and lies against the periphery of the aluminum sheet 16. Within the area of the binder surface 20 is a seal bead 22 and valleys 40 that extend in a square curvilinear path around the entire binder surface portion of the tool.

Cooperating tool 14 is also generally square and has a cavity-defining surface 24 in which a pressurized gas such as air or argon may be introduced through opening 26 to stretch form sheet 16 into conformation with forming surface 18 of tool 12. Cooperating tool 14 also has a binder surface portion 28 in the shape of a square flat surface that engages in the opposite side of sheet 16 from the binder surface 20 of forming tool 12. The entire peripheral binder surface 28 of tool 14 is flat and lies against the periphery of sheet 16.

In the practice of the stretch forming process, the aluminum sheet 16 is heated to a suitable superplastic forming temperature, for example, 400° C. to 550° C., and is placed between the binder surface portion of forming tool 12 and complementary tool 14 when they are spaced apart in a tool open position. When the tools are closed as seen in FIG. 1, the binder portions engage the edges or periphery of the sheet. In this arrangement, in order to form the sheet, a high pressure gas such as air is introduced through opening 26 into the cavity 24 behind the sheet. The high pressure gas, suitably at a pressure of about 100 psi, forces the portion of the sheet 16 within the binder portions of the tools upward as seen in FIG. 1 into contact with the forming surface 18 of tool 12. As the sheet is being stretched and expanded against the forming surface, gas within that chamber is expelled through opening 30. It is apparent that in order to effectively carry out this process, a gas tight seal must be provided at the periphery of the aluminum sheet so that gas does not leak out over the surface of the sheet between the binder portions of the forming tools.

Figure 5:
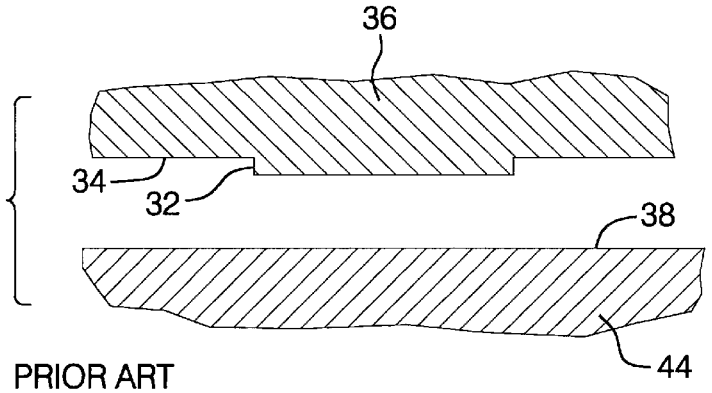
PRIOR ART FIG. 5
FIG. 5 is a view like FIG. 3 but showing a rectangular-shaped prior art bead.

In the prior art, a rectangular sealing bead 32 as illustrated in FIG. 5 is provided in the binder portion 34 of, for example, the forming tool 36. This rectangular bead extends around the periphery of a sheet to be formed. The binder surface 38 of the opposite tool 44 is flat (as shown) or machined with a complementary recess of rectangular cross section. The difficulty with this kind of bead is that, as described above, the aluminum sheet adheres to it, even welds to it, and it is very difficult to quickly and cleanly remove the sheet from the bead. This difficulty is encountered even when solid lubricants such as boron nitride, graphite or the like were employed as a barrier coating between the bead surface and the aluminum sheet. In accordance with the subject invention, a different bead configuration is provided.

Figure 3:
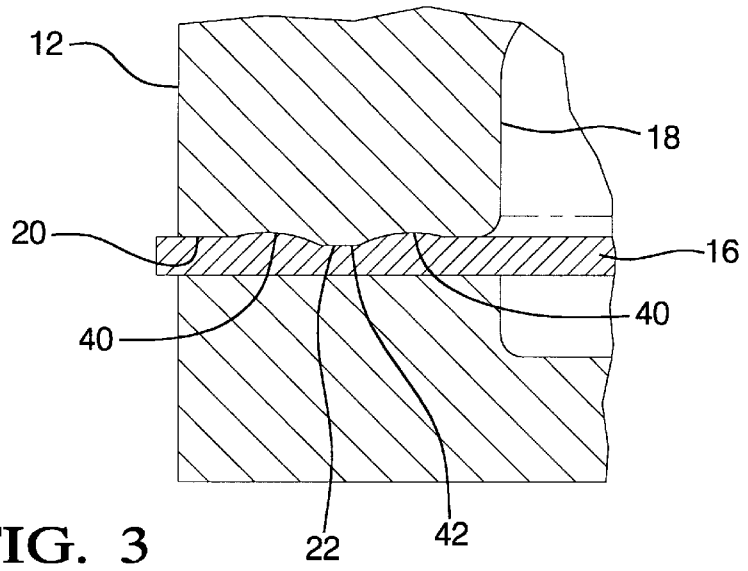
FIG. 3 is an enlarged view of the binder surface sections of the tools shown in FIG. 1.
Figure 4:
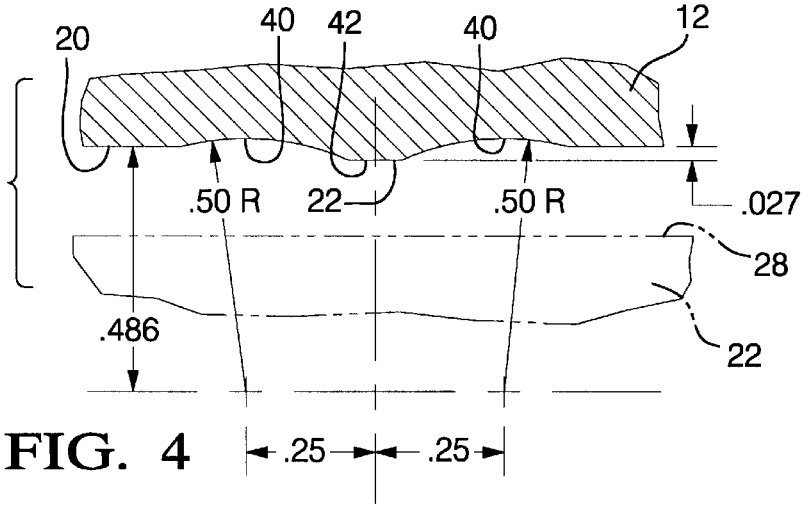
FIG. 4 is an enlarged view like FIG. 3 showing illustrative machining dimensions for making a recessed truncated cusp-shaped bead like that of FIG. 3.

FIG. 3 is a greatly enlarged view of a portion of the cross section of the binder portions (20, 28) of the forming die 12 and cooperating die 14 and aluminum sheet 16 illustrated in FIG. 1. A truncated cusp bead 22 has been formed in the binder surface of the forming tool. Parallel valleys 40 have been machined in the tool, one on each side of the cusp and coextensive with it. This truncated surface 42 on cusp 22 is formed at the time that the flat binder surface 20 of the forming tool 12 is machined. FIG. 4 shows some exemplary machining dimensions for the forming of cusp 22 by two spherical cutting tools (not shown) that trace the entire perimeter of binder surface 20 of forming tool 12. Referring to FIGS. 3 and 4, the radius of each of the cutting tools is 0.50 inch. The tools are offset from each other a distance of 0.250 inch from the centerline of the cusp. The center of each cutting tool is maintained at a distance of 0.486 inch from the intended final flat surface of the binder region of the forming tool. As the cutting tools trace their respective paths around the binder surface, they initially form a pointed cusp similar to that depicted at 122 in FIG. 7. The tools also cut valley portions 40 on either side of the initially pointed cusp. After the two spherical cutting tools have traced their respective paths in the binder section, a final flat cutting tool is supplied both to remove the tip of the cusp and to provide a truncated cusp with flat surface 42 (FIG. 1, 3 and 4) that is 0.027 inch above the flat plane of the binder surface 20. The resulting truncated cusp sealing bead 22 is then characterized by a truncated flat 42 with a valley 40 on either side, the flat 42 rising above the level of the plane surface 20 of the binder portion of the tool 12. As a result, as seen in FIGS. 1 and 3, when the two complementary tools 12, 14 are pressed together under hydraulic applied pressure to engage the periphery of aluminum sheet 16, the truncated cusp 22 cooperates with the opposite flat surface 28 and aluminum sheet 16 material is deformed over the top 42 of the truncated cusp 22 and into the two adjacent valleys 40. This deformation of the aluminum sheet in close engagement of the tools provides the necessary gas tight seal for the stretch forming operation. However, although the representation of the cusp 22 in FIGS. 3 and 4 is greatly enlarged, the volume displacement of the aluminum sheet is actually significantly less than with the rectangular or trapezoidal or even triangular cusp of the prior art. Upon the completion of the forming operation, the still hot but formed sheet 16 is readily removed from the truncated cusp seal 22.

Figure 6:
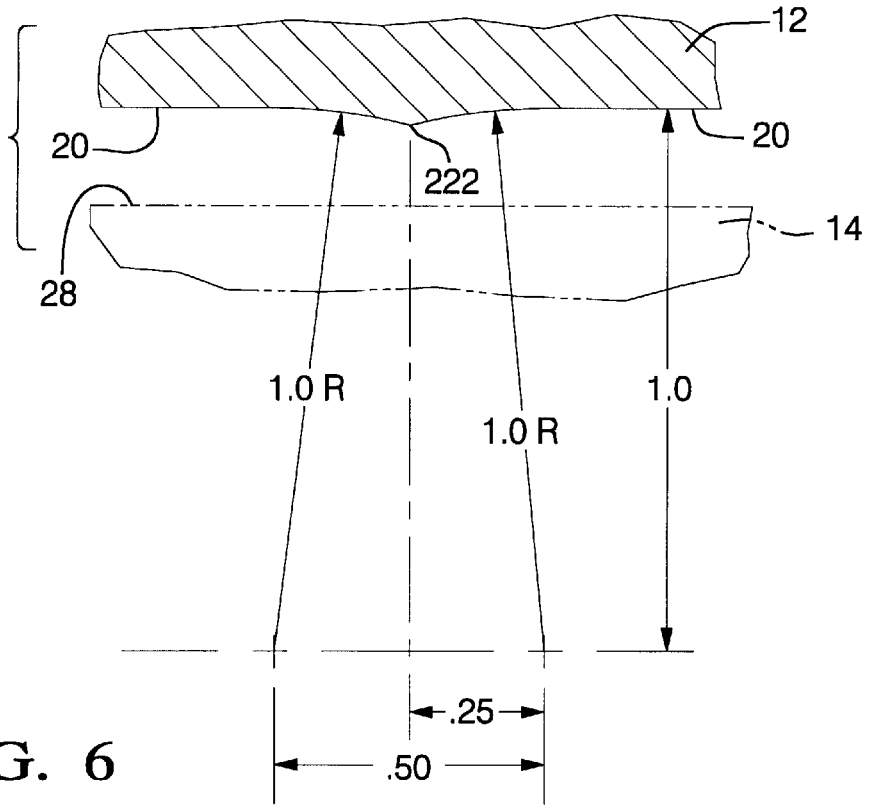
FIG. 6 is a view like FIG. 3 showing a plain cusp-shaped sealing bead.

FIG. 6 shows a simple cusp bead 222 in otherwise flat binder surface 20 of tool 12. Cusp bead 222 is effective for many stretch forming operations. FIG. 6 provides exemplary machining dimensions for the formation of a full cusp 222 that is not truncated and includes no valleys. Cusp bead 222 would be formed around the square binder section 20 of tool 12 like the truncated cusp illustrated in FIG. 2. Cusp 222 penetrates the aluminum sheet workpiece that is pressed between the forming tool 12 and against the flat surface 28 of the complementary tool 14. The peak 222 deforms the aluminum sufficiently to provide a gas-tight seal. However, again, the displacement of the aluminum is minimal, and the aluminum workpiece in the region of the binder portion of the tool is readily removed from the tool.

Figure 7:
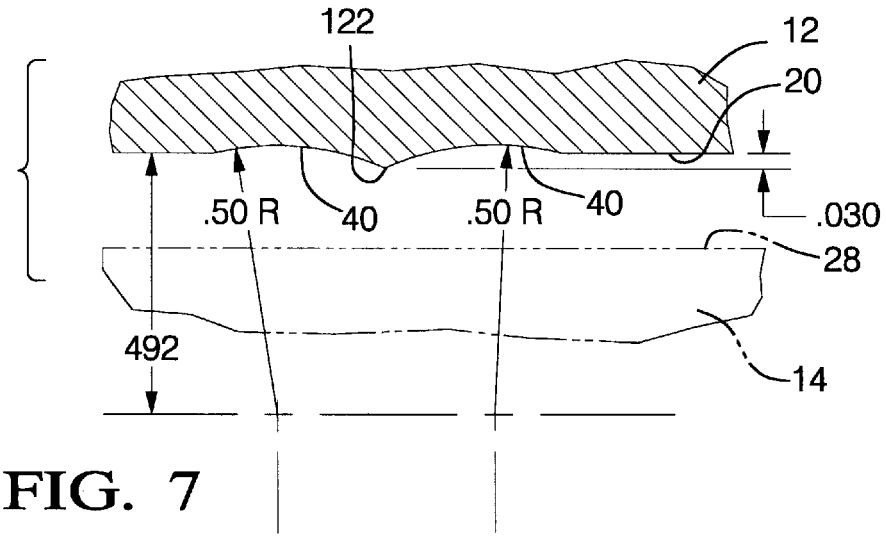
FIG. 7 is a view like FIG. 3 showing an untruncated cusp-shaped bead with valleys on both sides.

FIG. 7 shows yet another embodiment of the invention. In this case, the cusp 122 is not truncated but incorporates valleys 40 in the binder surface 20 of tool 12. FIG. 7 shows exemplary machining dimensions for the formation of the untruncated cusp with adjacent valleys.

In each of the described embodiments, the cusp bead is formed only on one surface. In all applications thus far investigated, the plane cusp or truncated cusp provides an adequate seal with the aluminum workpiece for stretch forming when the cusp is formed on only one of the surfaces. This greatly facilitates speedy and clean removal of the workpiece from the die.

While this invention has been described in terms of some specific embodiments, it will be appreciated that other forms can readily be adapted by one skilled in the art. Accordingly, the scope of this invention is to be considered limited only by the following claims.

I claim:

1. A forming tool for use in forming a metal sheet, said tool comprising a forming surface for said sheet and a binder surface for sealing engagement with said sheet, said binder surface having a flat width and a seal bead extending above said width, said seal bead having a cusp-shaped cross section.

2. A forming tool as recited in claim 1 in which said binder surface comprises a valley portion on at least one side of said bead and coextensive with said bead.

3. A forming tool as recited in claim 1 in which said bead has a truncated cusp-shaped cross section.

4. A forming tool as recited in claim 2 in which said bead has a truncated cusp-shaped cross section.

5. A set of complementary forming tools for forming a sheet of metal heated to a forming temperature, said sheet having first and second sides and a peripheral edge, said tools comprising a first forming tool having a first forming surface, against which said sheet is to be plastically deformed, and a first tool binder surface for sealingly engaging the first side of said sheet at its peripheral edge at a first tool sealing location, a second forming tool, complementary to said first tool, having a second tool binder surface for sealingly engaging the second side of said sheet at its peripheral edge opposite said first tool sealing location, and one of said first and second tool binder surfaces comprising a cusp-shaped sealing bead.

6. A forming tool as recited in claim 5 in which said one binder surface comprises a flat surface portion and a valley portion on each side of said bead and coextensive therewith, each said valley portion being adjacent said bead.

7. A forming tool as recited in claim 5 in which said bead has a truncated cusp-shaped cross section.

8. A forming tool as recited in claim 6 in which said bead has a truncated cusp-shaped cross section.

9. A set of complementary forming tools for forming a sheet of a superplastic-formable aluminum alloy heated to a superplastic forming temperature, said sheet having first and second sides and a peripheral edge, said tools comprising a first forming tool having a first forming surface, against which said heated sheet is to be plastically deformed under fluid pressure, and a binder surface for sealingly engaging the first side of said sheet at its peripheral edge, said binder surface comprising a linear cusp-shaped seal bead, and a second forming tool, complementary to said first tool, having a flat binder surface for sealingly engaging the second side of said sheet at its peripheral edge opposite said first tool binder surface.

10. A forming tool as recited in claim 9 in which said first forming tool binder surface comprises flat surface portions on each side of said bead and a valley portion on at least one side of said bead between said bead and flat surface portion.

11. A forming tool as recited in claim 9 in which said bead has a truncated cusp-shaped cross section.

12. A forming tool as recited in claim 10 in which said bead has a truncated cusp-shaped cross section.

* * * * *